United States Patent [19]

Pfyffer et al.

[11] Patent Number: 4,477,032

[45] Date of Patent: Oct. 16, 1984

[54] METHOD AN APPARATUS FOR INSERTING THREADS AND SIMILAR ITEMS INTO A WINDING DEVICE

[75] Inventors: Peter M. Pfyffer, Winterthur; Albert Ruegg, Pfäffikon, both of Switzerland

[73] Assignee: Rieter Machine Works, Ltd., Winterthur, Switzerland

[21] Appl. No.: 395,037

[22] PCT Filed: Oct. 23, 1981

[86] PCT No.: PCT/EP81/00169

§ 371 Date: Jun. 15, 1982

§ 102(e) Date: Jun. 15, 1982

[87] PCT Pub. No.: WO82/01539

PCT Pub. Date: May 13, 1982

[30] Foreign Application Priority Data

Oct. 31, 1980 [CH] Switzerland ..... 8118/80

[51] Int. Cl.[3] ..... B65H 54/02; B65H 54/20

[52] U.S. Cl. ..... 242/18 PW; 242/35.5 R

[58] Field of Search ..... 242/18 PW, 18 R, 18 DD, 242/35.5 R

[56] References Cited

U.S. PATENT DOCUMENTS

| | | | |
|---|---|---|---|
| 3,782,648 | 1/1974 | Ito et al. | 242/35.5 R |
| 3,964,721 | 6/1976 | Owens et al. | 242/18 PW |
| 4,023,741 | 5/1977 | Schar | 242/18 PW |
| 4,069,983 | 1/1978 | Muramatsu et al. | 242/35.5 A X |
| 4,081,149 | 3/1978 | Miller | 242/18 PW |
| 4,083,505 | 4/1978 | Burkhardt | 242/18 PW |
| 4,094,471 | 6/1978 | Tschentscher | 242/18 PW |
| 4,136,834 | 1/1979 | Tschentscher | 242/18 PW |
| 4,230,283 | 10/1980 | Hamaquchi et al. | 242/35.5 R X |
| 4,313,576 | 2/1982 | Claret et al. | 242/35.5 R X |

FOREIGN PATENT DOCUMENTS

| | | | |
|---|---|---|---|
| 5664 | 11/1979 | European Pat. Off | |
| 34680 | 9/1981 | European Pat. Off. | 242/18 PW |
| 2547401 | 5/1976 | Fed. Rep. of Germany | 242/18 PW |
| 2457820 | 6/1976 | Fed. Rep. of Germany | 242/18 PW |
| 2627643 | 6/1976 | Fed. Rep. of Germany . | |
| 2853605 | 12/1978 | Fed. Rep. of Germany . | |
| 2831130 | 2/1979 | Fed. Rep. of Germany | 242/18 PW |
| 2314128 | 1/1976 | France . | |
| 7611187 | 4/1976 | France . | |
| 2378708 | 9/1978 | France | 242/18 PW |
| 2086441 | 5/1982 | United Kingdom | 242/18 PW |

*Primary Examiner*—Stanley N. Gilreath
*Attorney, Agent, or Firm*—Werner W. Kleeman

[57] ABSTRACT

For disturbance-free insertion of threads (49*a*–49*d*) into a winding device (2) and for simultaneously taking over the threads on the bobbin tubes (5), the threads (49*a*–49*d*) are placed, using a suction gun (74), from the eyelets (70) (thread guides) provided at the apex of the traversing triangle, onto thread guide pins (51) mounted on a shiftable rail, which for the insertion into the winding device (2) is located at the free end of the bobbin chuck. Subsequently these guide pins (51) move the threads (49*a*–49*d*), as the rail (48) is shifted back, into such a position in front of the catching means (6), that the threads (49*a*–49*d*) are taken over by stationary, but pivotably arranged thread guides (41 or 79 respectively), from the guide pins 71, and are brought jointly, using a further pivoting movement, into the catching means (6).

10 Claims, 21 Drawing Figures

38
7d
34
VIII
40
41
43
42
39d
39c
39b
39a
31
30
36
VII
35
37
32
33
1a
68
67
69
66
64
65
VI
62
63
60
61
58
59
1b
B
72
71
47

31
32
75
77
40
41
42
43
65
59

XIV
XIV
76
75
77
40
32

32
31
78
73
77
76
75
40
B 70a-d
8
16
27a-d
28
29
3
31
32
B
76
77
5
40
F
D
D1
41
E
41
5
48
49a-d

METHOD AN APPARATUS FOR INSERTING THREADS AND SIMILAR ITEMS INTO A WINDING DEVICE

CROSS-REFERENCE TO RELATED APPLICATION this application is related to the commonly assigned copending U.S. application Ser. No. 395,036, filed June 15, 1982, entitled "Method and Apparatus for Inserting Threads and Similar Items into a Winding Device".

BACKGROUND OF THE INVENTION

The present invention relates to a new and improved method and apparatus for inserting threads and similar items into a winding device including at least two traversing devices arranged adjacently and associated bobbin tubes placed onto a bobbin chuck.

In its more particular aspects the method of the present development comprises the steps of taking over each thread, which comes from first thread guides above the winding device, by a manual or automatic thread suction device, placing the thread thereby onto a thread guide edge above and onto individual second thread guiding means below a traversing device and guiding the thread outside the traversing sweep zone. The threads are brought, using the lower second threads guides, in such a manner from the starting position at the exterior end of the bobbin chuck into a zone in front of a catching means of the corresponding bobbin tube. Subsequently, for simultaneous takeover of all threads, the threads are simultaneously guided into the catching means and then are wound into a bobbin package.

In its more particular aspects the apparatus of the present development comprises thread catching means associated with each bobbin tube, a winding device equipped with a thread guide edge above the traversing device, a a thread guide for each thread, which thread guide can be pivoted towards the bobbin tubes, and pivoting means, which pivot the thread guides jointly towards the bobbin tubes.

Side-by-side and double-stacked arrangements of winding devices, on the one hand, and multiple thread winding, on the other hand, as well as the requirement of simultaneous and disturbance-free transfer of all threads to all bobbin tubes in order to achieve uniform bobbin package weights require a replacement of the manual transfer of individual threads.

In a method and in an apparatus as known, for example, by German Patent Publication No. 2,627,643 and the cognate U.S. Pat. No. 4,136,834 granted Jan. 30, 1979, the threads supplied by a thread guiding device or by a supply device are taken over using a thread suction device. Subsequently the threads are guided on a thread guide rod on the side of an end face thereof in front of the winding device as a bundle, but mutually separated, using guide notches. Subsequently the threads are simultaneously moved through a guide slot in the winding device and placed into a position in front of the bobbin tubes at distances which correspond to those of the series arranged bobbin tubes. During this movement the threads are mutually separated using thread eyelets, which are movable along the support axis of the bobbin tubes, and which take over the threads.

Subsequently a pivoting beam supporting the thread eyelets is pivoted towards, or under, respectively, the bobbin tubes for the simultaneous insertion of the threads into the catching slots of the bobbin tubes.

Simultaneously with the movement of the thread eyelets the threads are lifted off the guide notches of the threaded guide rod in such a manner that they can move freely along the thread guide rod into the position corresponding to the thread tension.

The movement of the thread eyelets is effected by shiftable discs, which support the thread eyelets and which are supported on a rotatable threaded spindle. One of the discs is provided with inside threading and is moved as a nut (called nut-disc in the following) by the rotating threaded spindle. The other discs are slideably arranged on the spindle and are mutually connected via carrier rods.

The disadvantages of this apparatus are seen in that a possible inaccurate position of the discs, or of the threads respectively, in front of the catching slot is to be corrected by an additional movement parallel to the bobbin chuck axis, in order to ensure that each thread actually is caught by the catching slot. The possible inaccuracy is due, on one hand, to the inaccurate positioning of the nut-disc as the motor-driven spindle slows down to a stop and, on the other hand, to the possibility that the friction between the carrier rod and the disc exceeds the friction between the spindle and the disc.

Due to this circumstance also the disadvantageous step of the method is included that the threads are to be moved to beyond the positions of the catching threads in axial direction and jointly are to be moved back again, in order to ensure that the threads are caught by the catching slots.

SUMMARY OF THE INVENTION

Therefore, with the foregoing in mind it is a primary object of the present invention to provide a new and improved method of, and apparatus for, inserting threads or the like which is not associated with the aforementioned limitations and drawbacks of the prior art methods and constructions.

Now in order to implement this and still further objects of the invention which will become more readily apparent as the description proceeds, the method of the present development is manifested by the features that, the threads during the movement from the exterior end of the bobbin chuck to a position in front of the bobbin tubes are individually taken over using pivotable thread guides, and are held in an intermediate position by these pivotable thread guides before they are simultaneously taken over by the catching means, and that the threads in this intermediate position are held accurately in front of, and substantially parallel to, the thread catching means.

The apparatus of the present development is manifested by the features that, the first thread guide edge is movable (in a manner known as such) in such a manner, that the thread is guided, in an operative position of the first thread guide edge, outside the sweep zone of action C of the traversing device. Below said first thread guide edge there is provided a second thread guide edge, wich is movable from an idle position to an operative position. The number of notches on the second thread guide edge corresponds to the number of threads to be wound up. The threads are guidable, on the one hand, by the pivotable thread guides and, on the other hand, by the guide notches on the second thread guide edge in its operative position, in an intermediate position in such a manner, that the threads are guided substantially vertically, as seen in the viewing direction at right angles to the bobbin axis, and accurately in front of the corresponding catching means. Furthermore a guiding means is provided. In an initial position thereof the threads are guidable thereon individually at the exterior end of the bobbin chuck. At the guiding means the pivotable thread guides are guidable from an initial position within their pivoting range such that the threads are guidable, using the guiding means, into the winding device and to a position in front of the catching means and such that the threads can be taken over by the pivotable thread guides and guided into said intermediate position, as well as such that the pivotable thread guides can be pivoted, using the pivoting means for jointly pivoting the same towards the bobbin tubes, also into the initial position.

In one mbodiment of the apparatus according to the invention the guiding means for guiding the thread guides and threads are a guide rail, which is displaceable substantially parallel to the bobbin chuck axis, and which at the end substantially opposite to the exterior end of the bobbin chuck is provided with steps, and that one guide pin is provided for each step.

The advantages achieved by the present invention are seen substantially in that the threads for the takeover by the catching means are brought in simpler manner accurately and immobile with respect to the axial direction of the bobbin tubes to a position in front of the catching means.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
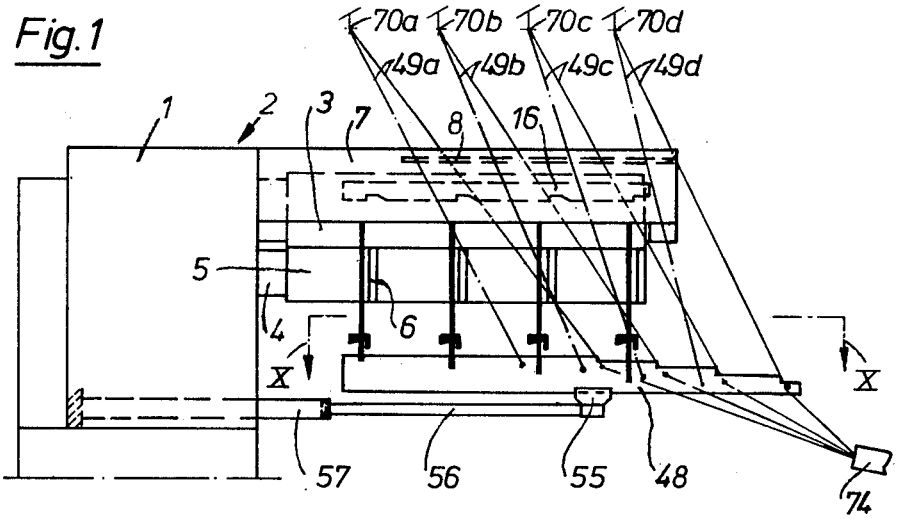
FIG. 1 is a semi-schematic side view of a first embodiment of an apparatus according to the invention including a winding device with a guide rail shown in its moved-out position.
Figure 2:
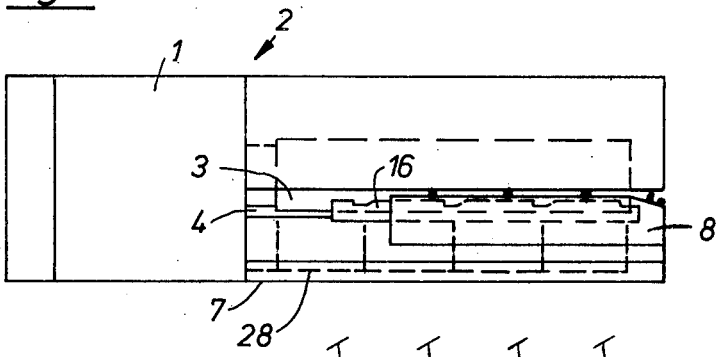
FIG. 2 is a top plan view of the winding device as shown in FIG. 1 with the first and the second thread guide edge shown semi-schematically.

It is to be understood that in order to simplify the illustration only enough of the construction of the apparatus for inserting threads into a winding device has been shown as needed for those skilled in the art to readily understand the underlying principles and concepts of the invention. Turning now specifically to FIGS. 1 and 2 of the drawings there is shown a machine housing 1 of a winding device 2 in which a friction drive drum 3 and a bobbin chuck 4 are rotatably supported (not shown). The bobbin chuck 4 is movable from a moved-away position (idle position) (not shown) into a moved-up position (operative position, FIGS. 1 and 2) and back.

In the moved-up position of the bobbin chuck 4 bobbin tubes 5, which can be clamped on the bobbin chuck 4, contact the friction drive drum 3, and thus are brought to the desired rotational speed and direction of rotation. On each of the bobbin tubes 5 a means comprising a catching slot catching slot 6 for clamping a thread caught therein is provided.

First thread guides 70*a–d* are provided each for a related thread 49*a–d*.

In a support member 7 mounted onto the machine housing 1 a first thread guide edge 8 is shiftably supported. The shifting devices 9*a* and 9*b* (FIG. 4) are provided by the cooperation of guide pins 10 mounted in the support member 7 with guide slots 71 provided in the first thread guide edge 8. The shifting movement is effected in one direction using a pneumatic piston 11, the cylinder 12 of which is mounted (not shown) on the support member 7, and in the other direction is effected using a tension spring 13. The tension spring 13 extends between a support member part 7*a* and the first thread guide edge 8. The cylinder head 14 of the piston 11 rests against the face side 15 of the first thread guide edge 8.

Below the first thread guide edge 8 a second thread guide edge 16 is supported rotatably and shiftably using a bearing block 17 mounted on a support member part 7*b*.

Shifting in the forward direction is effected using a pneumatic piston 18, the cylinder 19 of which is mounted (not shown) to the support member 7, and in the backward direction is effected using a pressure spring 21 arranged between the bearing block 17 and a grooved drum 20. The grooved drum in turn is connected at one end with a second shaft 22, to the other end of which the second thread guide edge 16 is connected.

The grooved drum 20 is provided with a groove 23, which engages with a groove-gliding member 24 mounted to a support member part 7*c*. The piston head 26 of the piston 18 rests against the face side 25 (FIG. 4) of the grooved drum 20.

The second thread guide edge 16 is provided with four guide notches 27*a*, 27*b*, 27*c* and 27*d* arranged at uniform mutual distances A. These distances correspond to the mutual distances between the catching slots 6 of the bobbin tubes 5 clamped on the bobbin chuck.

Below the two thread guide edges the thread traversing devices 28 (FIG. 11, indicated merely in FIG. 2), known as such generally, with the thread traversing guides 29 (FIG. 11) are arranged, which reciprocate the thread, in a manner known as such, within their traversing sweep zone C (FIG. 3) for building the package on the bobbin tube.

Below this traversing device 28 furthermore pivoting means 30 (FIGS. 5 and 11) is provided. The pivoting means 30 comprises a further shaft 31 supported rotatably within a hollow shaft 32.

The hollow shaft 32 in turn is rotatably supported in a bearing 33 inserted in a housing part 1*a* and in a bearing 34 inserted in a support member part 7*d*. The axial fixation of the hollow shaft 32 is effected on one side using a shaft flange 37, which with its face side rests against the bearing 33 and on the other side using a bearing cover 38 mounted in the support member part 7*d*, which with its face side rests against the hollow shaft 32.

Figure 8:
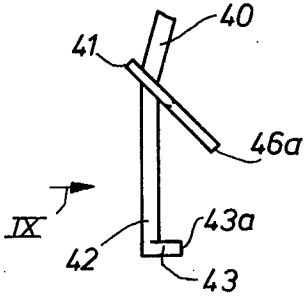
FIG. 8 shows second thread guides in the pivoting means as shown in FIG. 5 and viewed in the direction of arrow VIII in FIG. 5.

On the hollow shaft 32 thread guide elements 39*a–d* are pivotably arranged, each consisting of means for pivotably entraining the second thread guides 41 mentioned hereinafter and comprising a sleeve 35 rotatably supported on the hollow shaft 32 and of a rod 40 mounted thereon, and of second thread guides 41 mounted on the rod 40. On a rod extension 42 of, and slightly angled off with respect to, the rod 40 (FIG. 8) the free end is designed as a gliding shoe 43.

A helical spring 36 connected to the sleeve 35 on one hand and connected to the hollow shaft 32 on the other hand has the function of rotating the sleeve 35 in the direction B (FIGS. 7 and 11), i.e. counterclockwise, as seen from the exterior end of the bobbin chuck, and thus of pivoting the thread guide elements 39*a–d* in this direction.

A carrier pin 47 anchored in the shaft 31 and guided in guide slots 71 and 72 (FIG. 7) of the hollow shaft 32 and the sleeve 35, respectively, on one hand prevents axial movements of the shaft 31 and of the sleeve 35 and on the other hand limits, owing to the length of the guide slot 72 of the hollow shaft 32, the pivoting movement of the rods 40 (the function of which is to be described later on). The width of the guide slots 71 and 72 is chosen such, that the carrier pin 47 is guided therein in frictional contact.

The second thread guide 41 is provided with a thread guide notch 44 (FIG. 9), which is formed by the thread guide edges 45 and 46. The thread guide edges 45 and 46 form an angle of aperture $\alpha$ of less than 90 degrees, e.g. an angle of 60 degrees.

Figure 3:
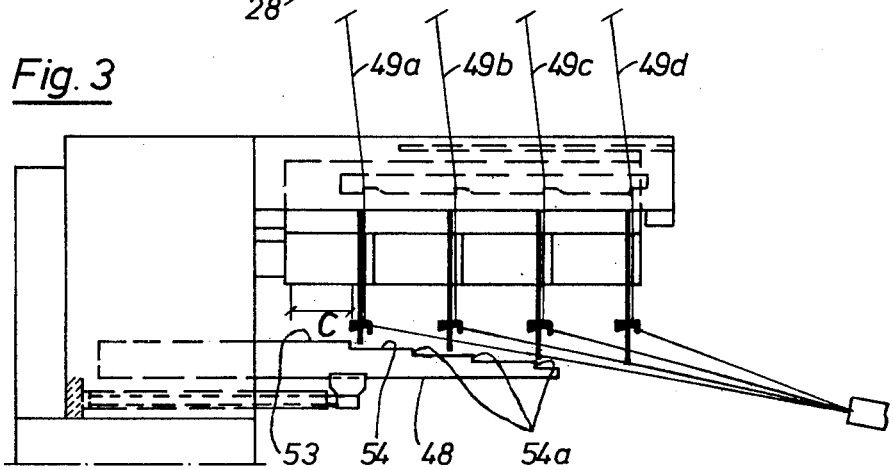
FIG. 3 is a side view of the winding device as shown in FIG. 1, the guide rail being shown in its moved-in position.
Figure 10:
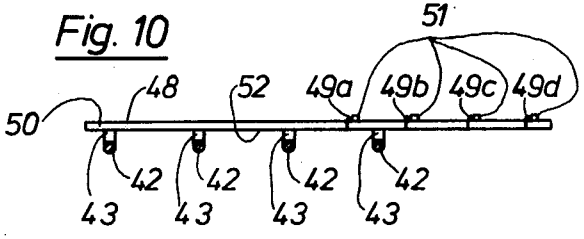
FIG. 10 is an individual top view of the guide rail as shown in FIGS. 1 and 2 and viewed in the direction of arrow X—X of in FIG. 1.

Also below the traversing device 28 guiding means forming a guide rail 48 is provided, displaceable substantially parallel to the bobbin chuck axis (FIGS. 1, 3 and 10). This guide rail 48 is used for guiding the thread guide elements 30*a–d* (FIG. 5), using the gliding shoes 43, as well as for guiding the threads 49*a*, 49*b*, 49*c* and 49*d* during the insertion of the threads into the winding device.

For this purpose the guide rail 48 is provided with thread guide pins 51 arranged on its inside 50 facing the bobbin chuck, whereas the opposed outside 52 is used for guiding the gliding shoes 43.

Figure 10A:
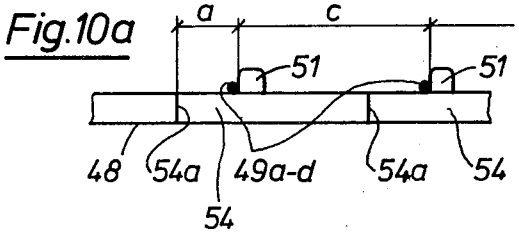
FIG. 10*a* shows a portion of the guide rail as shown in FIG. 10 at an enlarged scale.

Furthermore, the guide rail 48 is provided at its upper narrow side 53 (FIG. 3) with steps 54 in such a manner, that the distance a between the step face side 54*a* and the thread guide pin 51 (FIG. 10*a*) is equal to, or smaller than, the width b of the gliding shoe.

The gauge c (FIG. 10*a*), i.e. the distance from one thread guide pin 51 to another thread guide pin 51, which corresponds to the distances between the face sides 54*a*, is chosen such, that during the insertion of the threads 49*a–d* into the winding device using the guide rail 48, at the moment of the transfer of the threads 49*a–d* from the first thread guide edge 8 to the second thread second thread guide edge 16, the threads are guided on the guide edge 16 in such a manner, that each thread, as it slides on further on the second thread guide edge 16, reaches its corresponding guide notch 27*a–d*. The corresponding position of the guide rail 48 is shown in FIG. 1 with the dash-dotted indication of the threads 49*a–d*.

At its lower narrow side the guide rail 48 is connected via a carrier member 55 with the piston 56 of a pneumatic cylinder 57, which in turn is mounted on the machine housing 1.

For rotating the shaft 31 a crank mechanism 58 (FIGS. 5 and 6) is used, comprising a pneumatic cylinder 59, the cylinder back side of which is pivotably mounted onto a housing part 1*b*, as well as a link pin 60 for transmitting the forces between a link member 61 mounted on the piston end and a link member 63 mounted on the shaft end 62 of the shaft 31.

For rotating the hollow shaft 32, in analogous manner, a crank mechanism 64 is used, which comprises a pneumatic cylinder 65 pivotably connected with a housing part 1*b*, a link member 66 mounted on the piston end, a pair of link members 67 mounted onto the shaft end 68, and a link pin 69 for transmitting the forces between the link members 66 and 67.

Insertion of threads 49*a*, 49*b*, 49*c* and 49*d* into the winding device 2 is effected in the following manner:

Phase 1:

Threads coming from thread guides 70*a*, 70*b*, 70*c* and 70*d* (FIG. 1) or from the first a supply device (not shown) are sucked in using a so-called suction gun 74 or by an equivalent suction device (not shown) and are brought to the first thread guide edge 8, which has been brought into its operative position (FIG. 11), and are guided to the thread guide pins 51. This position of the threads is shown with solid lines in FIG. 11.

The threads located in this position no longer can be taken over by the traversing thread guides 29 and are extended freely in the space between the first thread guide edge 8 and the thread guide pins 51.

The first thread guides 70*a* through 70*d* form the apex of the traversing triangle and are arranged, in a manner known a such, substantially vertically above the centre of the traversing sweep zone of each bobbin tube 5, as indicated in FIG. 3 by the zone C.

Before the threads 49*a* through 49*d* are guided to the corresponding thread guide pins 51, the guide rail 48 has been moved from its starting position shown in FIG. 3 using the cylinder 57 (not described) into the working position shown in FIG. 1. Subsequently the shaft 31 (FIG. 5) is rotated upon activation of the cylinder 59 in such a manner, that the thread guide elements 39*a–d* are pivoted from their initial position D indicated with dotted lines in FIG. 11 into the position D1 indicated with dashed lines. This is effected as the carrier pin 47 is brought, owing to this rotation, from its contact in the guide slot 72 shown in FIG. 7 to its position shown in FIG. 11, i.e. to its contact with the other end of the guide slot 72, such that the helical spring 36 (FIG. 5) rotates the sleeve 35 in the direction of rotation B (FIG. 11), until the gliding shoes 43 rest against the guide outer side 52.

Figure 4:
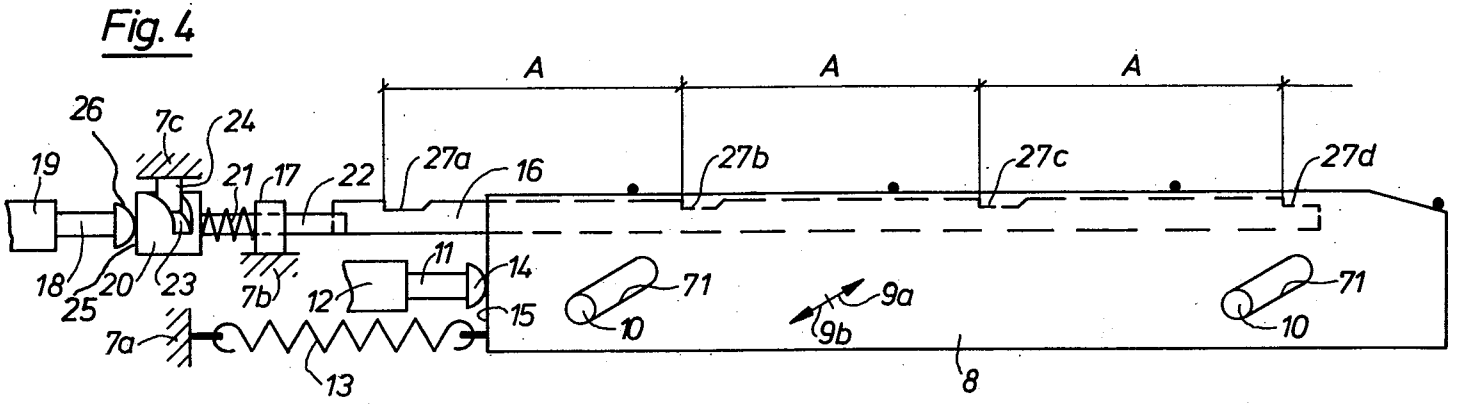
FIG. 4 is a top plan view of the first and of the second thread guide edges, shown semi-schematically, in the apparatus as shown in FIG. 1.

In this first insertion phase the threads contact, as shown also in FIGS. 2 and 4, the first thread guide edge 8, but not yet the second thread guide edge 16, which already has been brought into its operative position.

As visualized in FIG. 1, the threads 49*a* and 49*b* can be transferred, during the distribution to positions in front of the corresponding catching slots 6 of the bobbin tubes, to the second thread guide edge 16 only if they have reached the positions between the guide notches 27*b* and 27*a* (FIG. 4), and between the notches 27*b* and 27*c* respectively. For this reason the second phase, namely the distribution of the threads 49*a* through 49*d* to positions in front of the catching slots 6 is controlled as follows:

Phase 2:

Upon a further manual activation of a button (not shown) the pneumatic cylinder 57 starts moving the piston 56, and thus moving the guide rail 48 from the position shown in FIG. 1 into the one shown in FIG. 3. After some delay, namely at the moment in which the guide rail 48 has reached its position, in which the threads are indicated in FIG. 1 with dash-dotted lines, the first thread guide edge 8 is shifted back in the inclined direction 9*b* using the tension spring 13, as the cylinder 12 (FIG. 4) is released, back into the initial position indicated in FIG. 11 with dashed lines, in such a manner, that the threads 49*a* through 49*d* are placed onto the second thread guide edge 16, but not yet into the guide notches 27*a–d*, and slide thereon until each of the threads on its path to be covered still on the second thread guide edge 16 is stopped in the corresponding guide notch 27*a* through 27*d*, i.e. the thread 49 is stopped in the notch 27*a*, the thread 49*b* in the notch 27*b*, etc.

Figure 9:
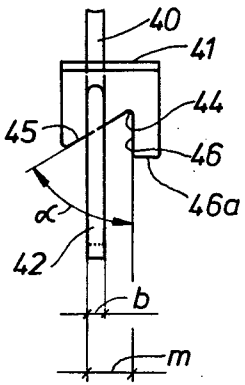
FIG. 9 shows the second thread guides as shown in FIG. 8 and viewed in the direction of arrow IX in FIG. 8.
Figure 11:
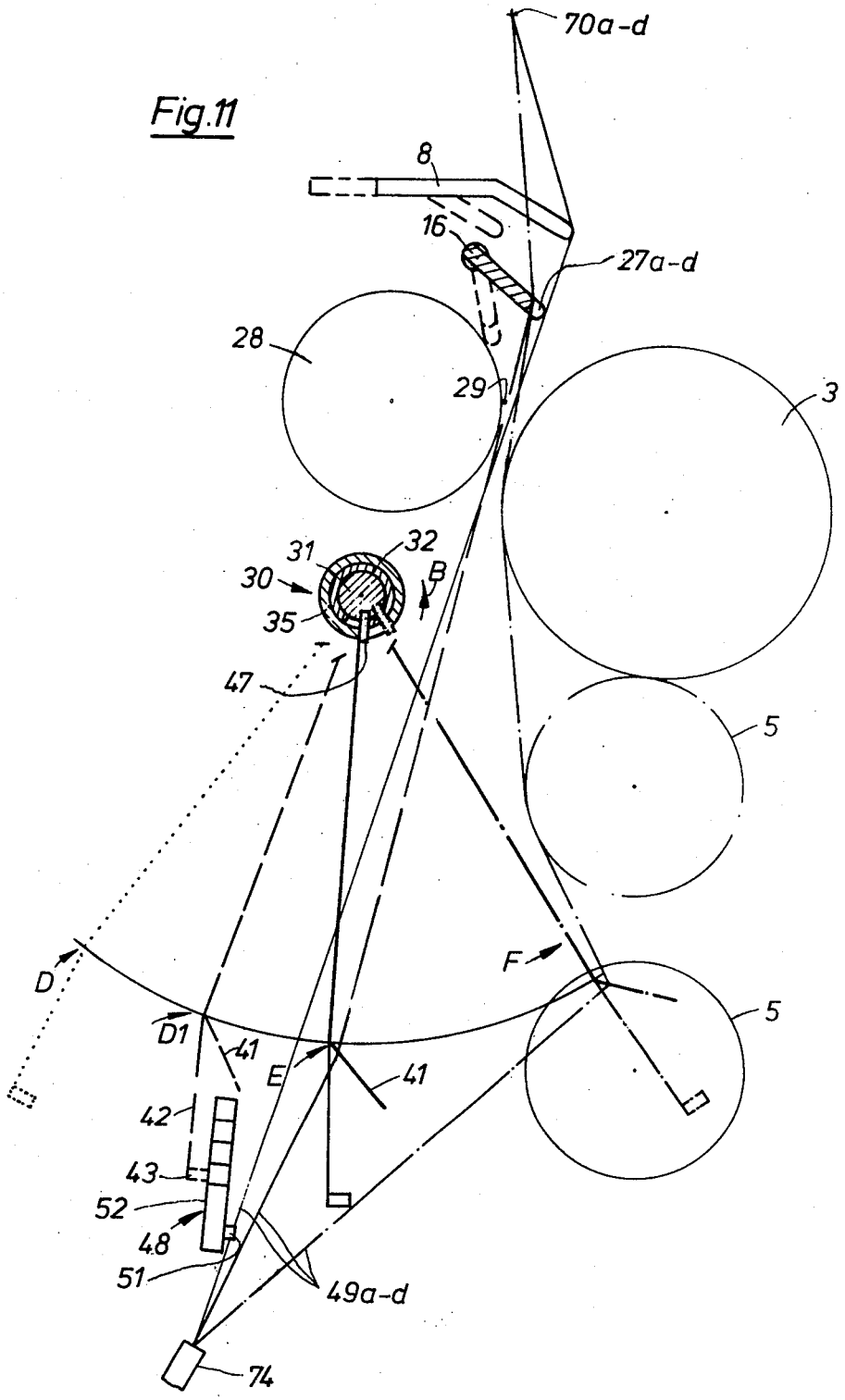
FIG. 11 is a schematic illustration of the thread path during the insertion of the thread into the winding device as shown in FIG. 1.
Figures 12, 13, 14:
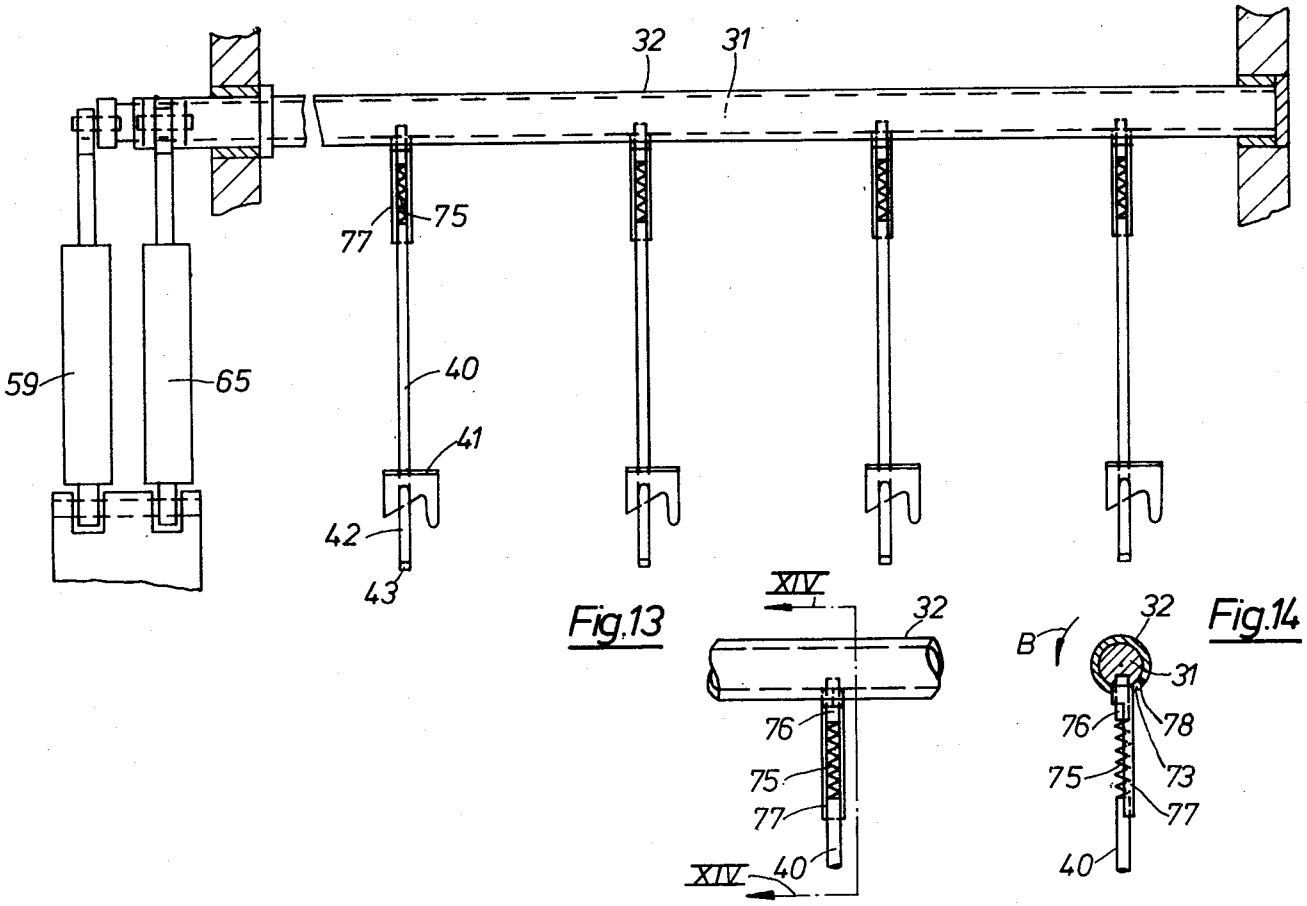
FIG. 12 shows a second embodiment of the apparatus according to the invention and specifically modified pivoting means thereof in a view similar to FIG. 5.
FIG. 13 is an enlarged view of a detail in the pivoting means as shown in FIG. 12.
FIG. 14 is a cross-section in the direction XIV—XIV of the detail as shown in FIG. 13.
Figure 15:
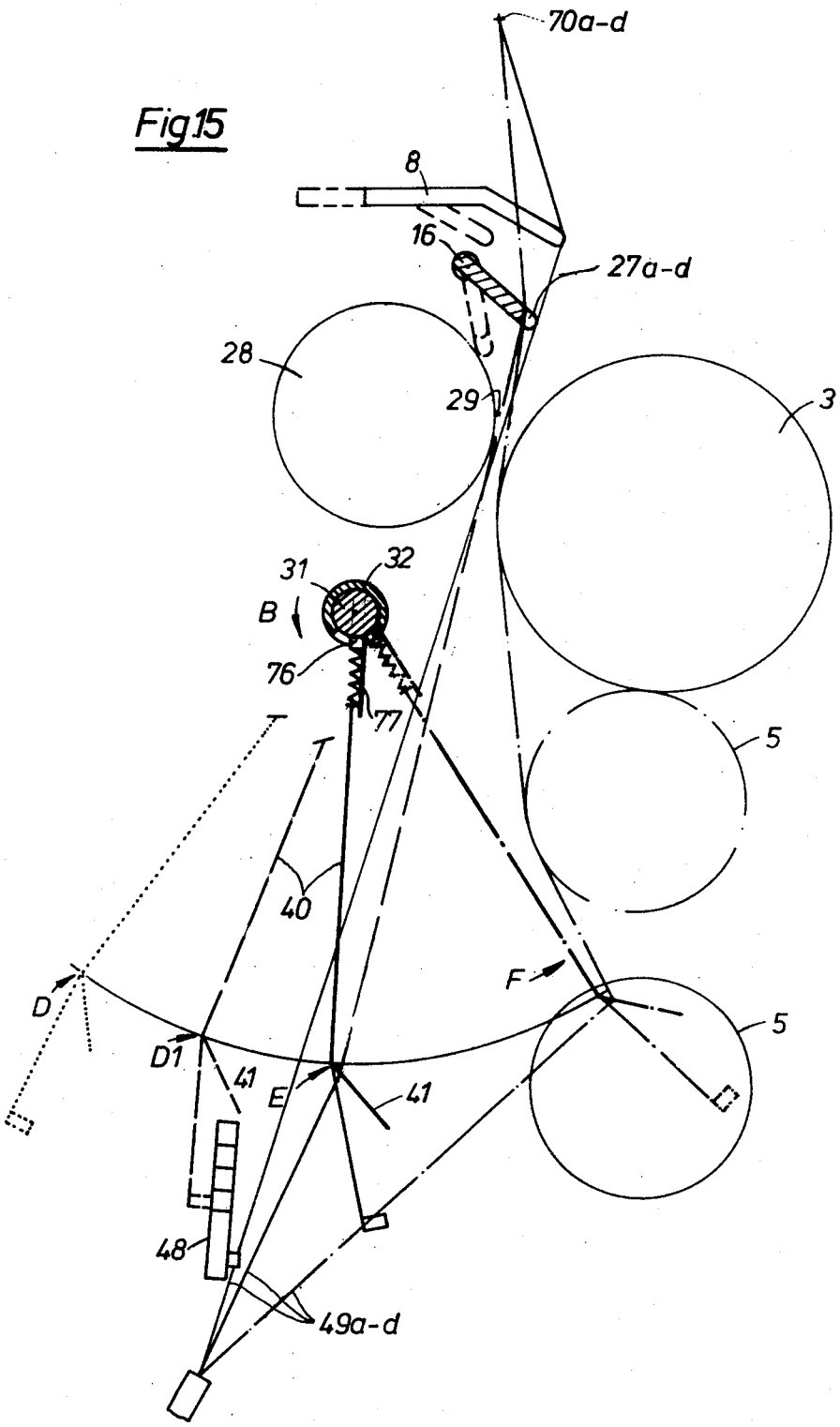
FIG. 15 is a schematic illustration of the thread path similar to FIG. 11 in the second embodiment including the pivoting means as shown in FIG. 12.
Figure 16:
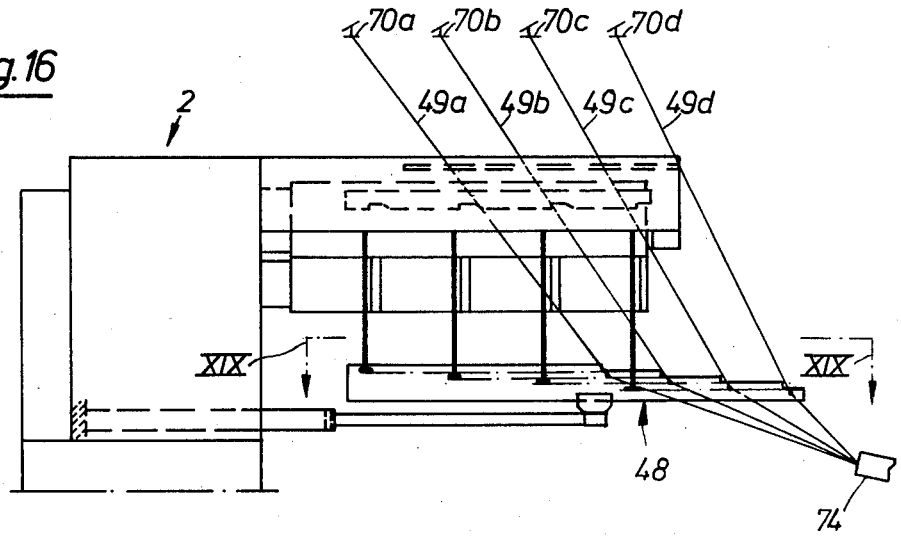
FIG. 16 is a side view similar to FIG. 1 of a third embodiment of the apparatus according to the invention including a winding device with the guide rail shown in its moved-out position and with modified second thread guides.
Figure 20:
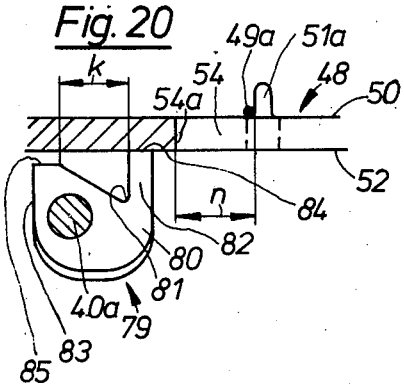
FIG. 20 is an enlarged view of a second thread guide and the guide rail including the guide pin of the guide rail as shown in FIG. 19.
Figure 19:
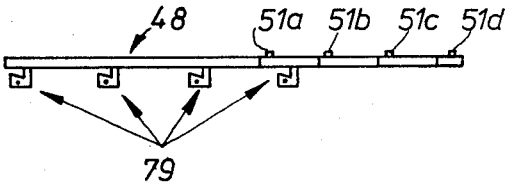
FIG. 19 is an individual top view of the guide rail as shown in FIGS. 16 and 17 in the direction of arrows XIX—XIX in FIG. 16
Figure 17:
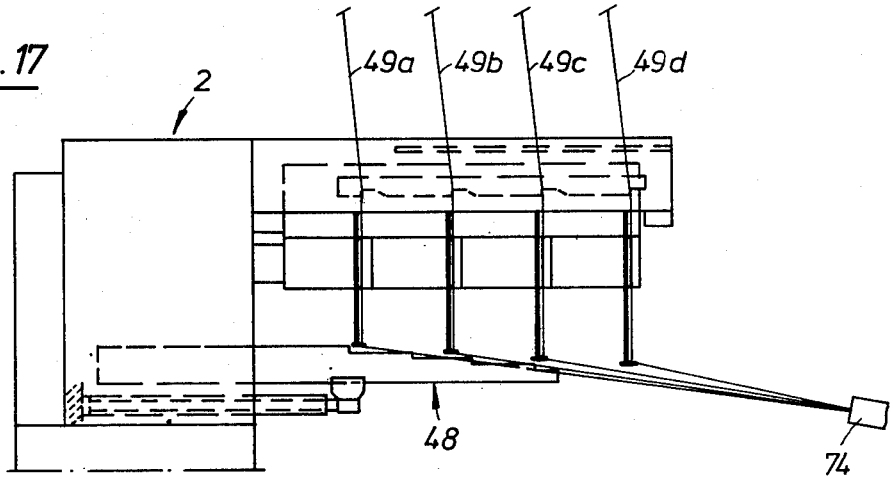
FIG. 17 is a side view of the winding device as shown in FIG. 16 with the guide rail shown in its moved-in position.
Figure 18:
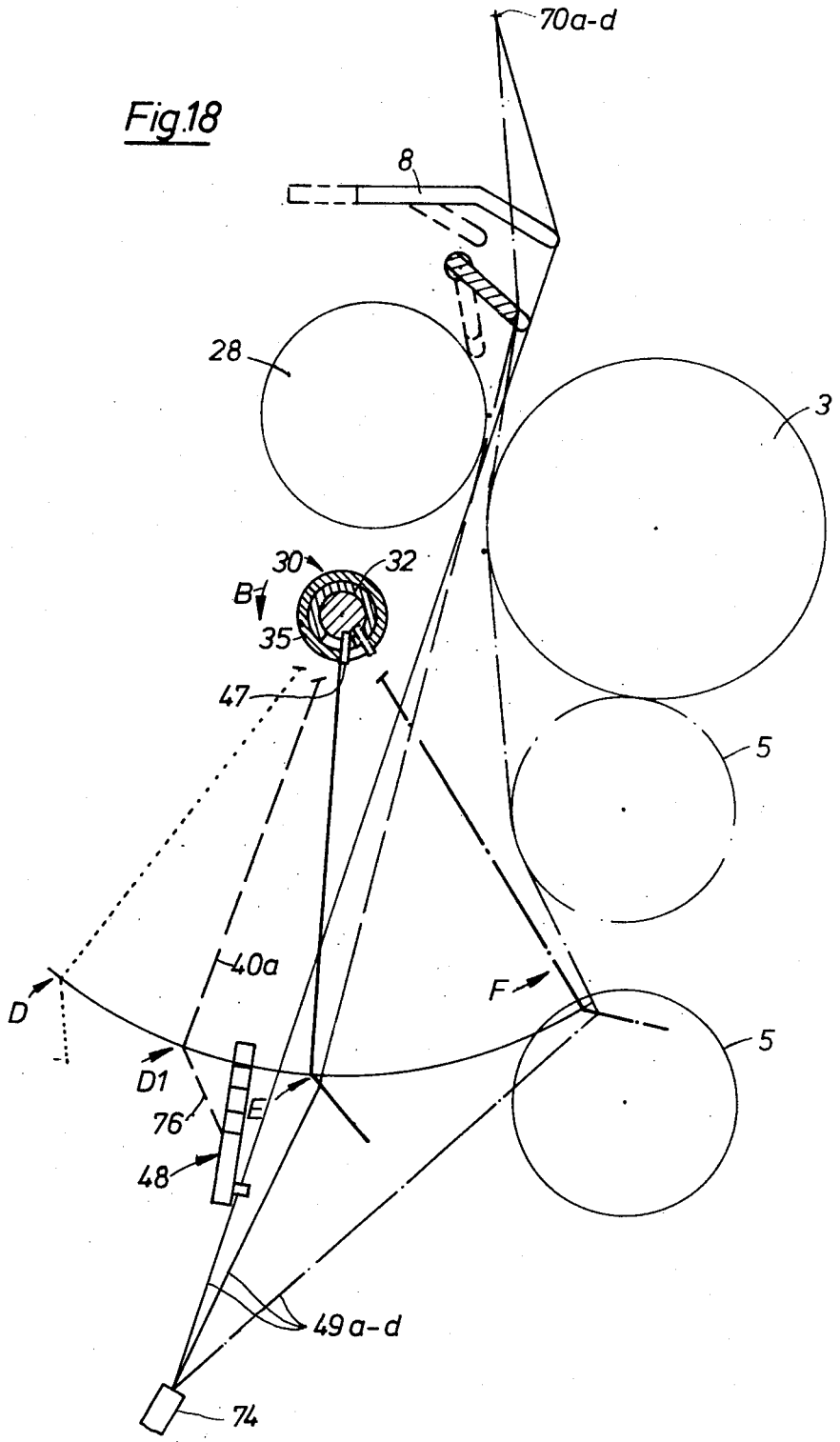
FIG. 18 is a schematic illustration of the thread path similar to FIG. 11 in the third embodiment including the second thread guides as shown in FIGS. 16 and 17.

As the guide rail 48 is shifted further towards the initial position, the steps 54 (FIG. 3) release the further pivoting path of the second thread guides 41 (FIG. 11), as the gliding shoes 43 pivot past the face sides 54*a* over the steps 54. This pivoting movement continues until the sleeve 35 (FIG. 7) with its guide slot 71 rests against the carrier pin 47 (shown in FIG. 11 with solid lines). In this process the threads 49*a–d* are taken over by the second thread guides 41. This position of the threads between the second thread guides 41 and the guide notches 27*a–d* is indicated in FIG. 11 with dashed lines. The spatial relationship between the gliding shoe 43 and the second thread guide 41 is chosen, for ensuring this thread take-over, in such a manner, that the guide edge 46 (FIG. 9) already is placed, as the gliding shoe 43 pivots over the corresponding step, further than the thread, as seen in the direction of the bobbin chuck axis and from the free end of the bobbin chuck, before the gliding shoe 43 (FIG. 11) moves the thread off the thread guide pin 51. The distance between the face side 43*a* (FIG. 8) of the gliding shoe and the thread thus is kept larger than the distance between the thread and the finger tip 46*a*. In order to ensure this, if the gliding shoes 43 are all of the same length, the rod extension 42 is to be aligned substantially parallel to the outer surface 42 of the guide rail 48. Furthermore, the distance m, shown in FIG. 9, is to exceed the distance a shown in FIG. 10*a*.

At the end of this second phase the threads are arranged as shown in FIG. 3, and as indicated in FIG. 11 with dashed lines, within the winding device, freely extended between the guide 27*a–d* and the second thread guides 41, to the side of the traversing sweep zone C, as well as accurately in front of, and substantially parallel to, the corresponding catching means. Furthermore the cylinder 59 remains pressurized in the same sense, is prevented, however, from moving further, as the carrier pin 47 rests against the end of the guide slot 72.

Figures 5, 6, 7:
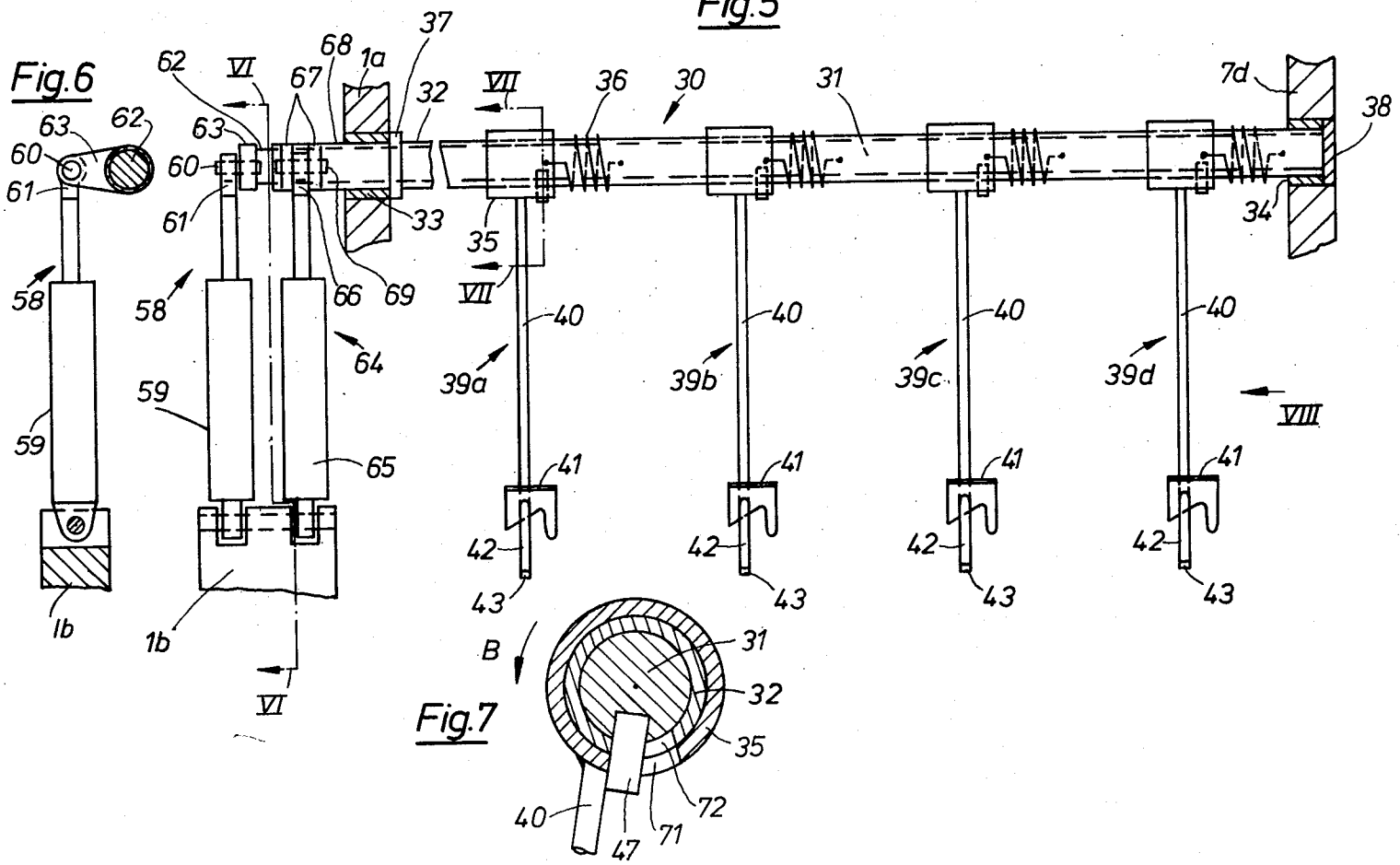
FIG. 5 is a semi-schematic view of the pivoting means for the second thread guides in the apparatus as shown in FIG. 1.
FIG. 6 shows a detail in section of the pivoting means as shown in FIG. 5 and seen in the direction of arrows VI—VI in FIG. 5.
FIG. 7 shows a cross-section of a detail in the pivoting means as shown in FIG. 5 and viewed in the direction VII—VII.

Phase 3:

In this phase the pneumatic cylinder 65 (FIG. 5) is activated, and thus the hollow shaft 32 is rotated in the direction B (FIG. 7). Thus further rotation of the shaft 31 is rendered possible, in such a manner that the thread guide elements 39*a–d* are pivoted jointly into the position F shown in FIG. 11 with dash-dotted lines. Thus the threads 49*a–d* are brought into the corresponding catching slots 6 and are severed from the suction gun 74, in such a manner, that the windings begin to form on the bobbin tube.

The lift of the cylinder 65 is adapted to the pivoting movement of the second guides 41 between the positions E and F. The lift of the cylinder 59 is chosen such, that the second thread guides 41 pivot between the positions D and F. The force of the cylinder 59 is laid out such, that the positions D, E and F are determined by the lift and the force of the cylinder 65.

After the thread guide elements 39*a–d* have reached the position F, the pneumatic cylinder (FIG. 5) is released. Thus the spring 21 moves the grooved drum 20, and thus the second thread guide edge 16, back to the initial position. By the spiral on twisting movement thus generated the second thread guide edge 16 is simultaneously rotated and pivots the guide notches 27*a–d* away from the thread path. The threads 49*a–d* now are freely extended between the first thread guides 70*a–d* and the bobbin tubes 5, and owing to this thread tension tend to move into the traversing sweep zone C, within which they are taken over by the traversing thread guides 29. During this spiral movement the threads are guided in the guide notches 27*a–d* in such a manner, that between the catching slot 6 and the traversing sweep zone C a number of reserve windings is placed.

As the threads 49*a–d* are taken over by the traversing thread guides 29, the normal winding process begins.

Phase 4: Finally the cylinders 59 and 65 are activated in the inverse direction (not shown), in such a manner, that the thread guide elements *39a–d* are pivoted back into their position D shown with dotted lines in FIG. 11. This initial position is shown in FIG. 7.

In FIGS. 12 through 15 an alternative embodiment A of the invention is illustrated.

In this alternative embodiment the means for pivotably entraining the second thread guides comprise a helical spring 75 (FIG. 5), instead of the sleeve 35 and the helical spring 36. The spring 75 is connected on one hand with the rod 40 and on the other hand with a pin 76, which is anchored in the first shaft 31. The other elements connected with the rod 40 correspond to the ones already described and are designated with the same reference characters. Additionally, a trough-shaped stop 77 taking up the elements 75, 76 and 40 prevents the deflection of the helical spring 75 in this direction. The stop 77 is guided, with its end adjacent to the shaft 31, in the guide slot 73 in frictional contact, in such a manner that axial displacements of the shaft 31 are prevented owing to this measure.

The insertion of the threads 49*a–d* into the winding device 2 is effected substantially as described before, with the exception, that the pivoting of the second thread guides 41 over the steps 54 is effected using the tension force of the helical spring 75. The following part of the description thus is limited to a description of the function of the new elements:

In the first phase, after the guide rail 48 has been moved into the operative position (FIG. 1), the shaft 31 is rotated in the direction B (FIG. 15), until the stop 77 (FIG. 14) rests against the slot end 78 of the slot 73. In this position the gliding shoes 43 (see FIG. 11) contact the guide rail outside surface 52, i.e. the thread guide elements 39*a–d* are in the position shown with dashed lines in FIG. 15. In this position D1 of the thread guide elements 39*a–d* the helical spring 75 is bent (not shown) according to the position of the pin 76 and of the rod 40, i.e. does not rest against the stop 77.

During the retraction of the guide rail 48 into the initial position the pivoting movement into the position E of the thread guide elements 39*a–d* shown with solid lines is effected using the tension force of the spring 75, until the spring 75 as well as the end of the rod 40 facing the spring rest against the stop 77. The further sequence of the process, i.e. the rotation of the hollow shaft 32 and of the shaft 31 for pivoting the thread guide elements 39*a–d* into the position F, etc., are effected as described before.

A further application possibility of the present invention is an alternative embodiment is shown in FIGS. 16–20. In this alternative embodiment the thread guide element 79 (FIG. 20) consists of a second thread guide 80, mounted onto a rod 40*a*, with a thread guide notch 81 formed by a long finger 82 and a short finger 83.

The rod 40*a* can be mounted in analogy to the rod 40 at the same point of the sleeve 35.

The functions during the insertion of the threads 49*a–d* into the winding device 2 correspond to the functions described for the phases 1–4, with the exception, that the second thread guides 80 glide directly on the face sides 84 and 85; over the outside surface 52 of the guide rail 48. This is effected e.g. for the thread 49*d* as follows:

As the guide rail 48 moves back into the initial position, the face side 84 first glides on the outside surface 52 and subsequently, as it pivots over the corresponding step 54, it transfers the guiding function to the short finger 83.

The lengths of the two fingers 82 and 83 are chosen such, that as the long finger 82 is placed over the step 54, the face side 84 has not yet reached the inside surface 50, i.e. that the thread 49*d* passes the finger 82.

Only after also the finger 83 has ceased to be guided on the outside surface 52, i.e. as thus the complete pivoting of the second thread guide 80 over the step 54 is rendered possible, the thread 49*d* is taken over by the thread guide notch 81 and is pivoted further, until the rod 40*a* comes to a rest in position E. This is effected under the condition, that the distances k (FIG. 20) between the face sides 84 and 85 exceeds the distance n between the face side 54*a* of the step 54 and the thread guide pin 51. For the distances between the face sides 54*a* of the other steps and the other steps 51 the same condition applies.

After all the threads 49*a–d* have been taken over in this manner, the further sequence of process steps is effected as described for the phases 3 and 4.

The alternative embodiment B also can be combined with the alternative embodiment A.

The method described as well as the apparatus also can be applied with other thread catching devices, which are provided at the side of the bobbin tubes, e.g. on the bobbin chuck itself. Such devices replace the above mentioned thread catching slots 6.

A bobbin chuck of such type is known e.g. from U.S. Pat. No. 4,106,711 and from British Pat. No. 1.562.548.

The third phase, with the bobbin chuck shown in the patents mentioned, with the conical thread guide surface 11 and the teeth 12, is effected as follows:

The thread guide elements 39*a–d*, and 79 respectively, bring the corresponding thread 49*a–d* into the position F on the corresponding surface, as they are tilted. Owing to the prevailing thread tension, generated by the suction gun, the thread slides on the surface 11 into the action zone of the teeth 12 and is caught and severed, as described in the patents.

The position of a surface 11 along the bobbin chuck substantially corresponds to the position of a thread catching slot 6.

While there are shown and described present preferred embodiments of the invention, it is to be understood that the invention is not limited thereto, but may be otherwise variously embodied and practiced within the scope of the following claims. Accordingly, what we claim is:

1. A method of inserting threads or the like into a winding device including at least two traversing devices in axial juxtaposition defining a sweep zone, bobbin tubes associated thereto and each provided with catching means for a related one of said threads, a bobbin chuck having an exterior end and carrying said bobbin tubes, a thread suction device, and first thread guides each associated with a related one of said threads and being arranged above said winding device, said method, comprising the steps of:

taking up each said thread by means of said suction device as the threads come from said first thread guides;

placing each said thread by means of said suction device onto a thread guide device arranged above said sweep zone;

guiding said threads by means of said suction device outside said sweep zone defined by said at least two traversing devices;

placing pivotable second thread guides, which are arranged below said sweep zone defined by said at least two traversing devices and each of which second thread guides is associated with a related one of said threads, in an initial position at said exterior end of said bobbin chuck;

displacing said second thread guides from said initial position into a position in front of said catching means while simultaneously taking up each said thread by a related one of said second thread guides;

holding said threads in an intermediate position precisely in front of said catching means;

taking-up all said threads in said catching means; and winding-up said threads on said bobbin tubes.

2. An apparatus for inserting threads or the like into a winding device, said apparatus comprising:

at least two traversing devices defining a sweep zone and being arranged in axial juxtaposition;

a bobbin chuck defining an axis and an exterior end;

bobbin tubes having an axis and being associated with said at least two traversing devices and supported by said bobbin chuck;

catching means each operatively associated with a related one of said bobbin tubes;

a first thread guide edge arranged above said at least two traversing devices;

said first thread guide edge being displaceable into an operative position;

said first thread guide edge in said operative position thereof guiding said threads outside said sweep zone defined by said at least two traversing devices;

a predetermined number of pivotable thread guides each associated with a related one of said threads;

pivoting means for jointly pivoting said pivotable thread guides into an initial position thereof and from said initial position through a predetermined pivot range towards said bobbin tubes;

a second thread guide edge arranged below said first thread guide edge and provided with guide notches corresponding in number to the number of said threads to be wound up;

said second thread guide edge being movable from an idle position to an operative position;

guiding means operatively associated with said pivotable thread guides and displaceable between an initial position and an operative position;

said guiding means in said operative position thereof individually guiding said threads at said exterior end of said bobbin chuck;

said guiding means, when displaced from said operative position into said initial position thereof, permitting said pivotable thread guides to be pivoted within their predetermined pivot range from said initial position thereof by said pivoting means in order to take up said threads;

said pivotable thread guides and said guide notches of said second thread guide edge in said operative position of said second thread guide edge guiding said threads into an intermediate position; and each said thread in said intermediate position thereof being guided substantially vertically, as seen substantially normally with respect to said bobbin tube axis, and so as to extend precisely in front of a related one of said catching means.

3. The apparatus as defined in claim 2, wherein:

said guiding means comprise a guide rail for guiding said pivotable thread guides and said threads;

said guide rail having a longitudinal side wall and an end disposed substantially adjacent said exterior end of said bobbin chuck in said operative position of said guiding means;

means for displacing said guide rail substantially parallel to said bobbin chuck axis;

a plurality of steps provided at said end of said guide rail; and a plurality of thread guide pins each provided at a respective one of said steps.

4. The apparatus as defined in claim 3, wherein:

said pivotable thread guides are guided at said longitudinal side wall of said guide rail; and each said pivotable thread guide picking up a related one of said threads as each said pivotable thread guide is pivoted over a related one of said steps.

5. The apparatus as defined in claim 2, wherein:

said pivoting means comprises:

a rotatably and drivably journalled hollow shaft;

a further shaft rotatably and drivably journalled in said hollow shaft;

means for pivotably entraining said pivotable thread guides;

means for rotatably driving said hollow shaft and said further shaft to pivot said pivotable thread guides into said initial position thereof, into an intermediate position thereof, and into a catching position thereof; and said threads guided by said guide notches at said second thread guide edge and by said pivotable thread guides being catchable by said catching means in said catching position of said pivotable thread guides.

6. The apparatus as defined in claim 5, wherein:

said means for pivotably entraining said pivotable thread guides comprises a respective sleeve provided for each pivotable thread guide which is rotatably and drivably arranged on said hollow shaft; and a rod connecting each said pivotable thread guide and its related sleeve.

7. The apparatus as defined in claim 6, wherein:

said means for pivotably entraining said pivotable thread guides further comprises:

a respective spring interconnecting said hollow shaft and a related one of said sleeves;

a plurality of carrier pins anchored at said further shaft;

a guiding slot provided in each said sleeve; and each said carrier pin being force-lockingly connected to its related sleeve through said guiding slot.

8. The apparatus as defined in claim 5, wherein:

said means for pivotably entraining said pivotable thread guides comprises:

a plurality of spacedly arranged pins anchored in said further shaft;

a respective rod for carrying a related one of said pivotable thread guides;

a respective spring connected to a related one of said pins and to a related one of said rods carrying a related one of said thread guides; and said pivoting means comprising said springs, said further shaft and said hollow shaft.

9. The apparatus as defined in claim 8, further including:

a plurality of spacedly arranged stops anchored in said further shaft; and said stops limiting the pivoting movement of said pivotable thread guides under the action of said springs in the direction of said bobbin tubes.

10. The apparatus as defined in claim 5, wherein:

said hollow shaft is drivable in such a manner that said pivotable thread guides are pivotable from said intermediate position into said catching position thereof.

* * * * *

UNITED STATES PATENT AND TRADEMARK OFFICE

CERTIFICATE OF CORRECTION

PATENT NO. : 4,477,032

DATED : October 16, 1984

INVENTOR(S) : PETER M. PFYFFER et al

It is certified that error appears in the above-identified patent and that said Letters Patent is hereby corrected as shown below:

In the Abstract, last line, after "means (6)." add --In this manner the winding process is started simultaneously on all bobbin tubes.--

Column 1, line 29, delete "threads" and insert --thread--

Column 1, line 40, after "a" delete "a"

Column 2, line 29, after "moved" delete "to"

Column 2, line 58, after "zone" delete "of action"

Column 3, line 17, delete "mbodiment" and insert --embodiment--

Column 4, line 54, delete "catching slot" (first occurrence)

Column 6, line 14, delete "30a-d" and insert --39a-d--

Column 6, line 35, after "on the" insert --second thread--

Column 6, line 63, after "from" insert --the first--

Column 7, line 28, after "guide" insert --rail--

Column 8, line 20, delete "42" and insert --52--

Column 8, line 26, after "guide" insert --notches--

Column 8, line 46 (counting from the top) after "second" insert --thread--

UNITED STATES PATENT AND TRADEMARK OFFICE

CERTIFICATE OF CORRECTION

PATENT NO. : 4,477,032

DATED : October 16, 1984

INVENTOR(S) : PETER M. PFYFFER et al

It is certified that error appears in the above-identified patent and that said Letters Patent is hereby corrected as shown below:

Column 8, line 53, after "cylinder" insert --19--

Column 8, line 56, after "spiral" delete "on" and insert --or--

Column 10, line 16, after "that the" delete "distances"and insert --distance--

Column 12, line 57 (Claim 8, line 1) delete"whererin" and insert --wherein--

Signed and Sealed this

*Eighteenth* Day of *June 1985*

[SEAL]

*Attest:*

DONALD J. QUIGG

*Attesting Officer* *Acting Commissioner of Patents and Trademarks*